US007936890B2

(12) United States Patent
Naylor et al.

(10) Patent No.: US 7,936,890 B2
(45) Date of Patent: May 3, 2011

(54) SYSTEM AND METHOD FOR GENERATING AUDITORY SPATIAL CUES

(75) Inventors: Graham Naylor, Smørum (DK); S. Gert Weinrich, Smørum (DK)

(73) Assignee: Oticon A/S, Smorum (DK)

( * ) Notice: Subject to any disclaimer, the term of this patent is extended or adjusted under 35 U.S.C. 154(b) by 1213 days.

(21) Appl. No.: 11/593,026

(22) Filed: Nov. 6, 2006

(65) Prior Publication Data

US 2007/0230729 A1 Oct. 4, 2007

Related U.S. Application Data

(60) Provisional application No. 60/786,377, filed on Mar. 28, 2006.

(51) Int. Cl.
*H04R 25/00* (2006.01)

(52) U.S. Cl. ..... 381/313; 381/312

(58) Field of Classification Search ..... 381/23.1, 381/312–313, 315–317, 320, 92
See application file for complete search history.

(56) References Cited

U.S. PATENT DOCUMENTS 6,539,096 B1 * 3/2003 Sigwanz et al. ..... 381/313
7,031,483 B2 * 4/2006 Boone et al. ..... 381/313
7,076,069 B2 * 7/2006 Roeck ..... 381/313
7,209,568 B2 * 4/2007 Arndt et al. ..... 381/313
2005/0041824 A1 2/2005 Arndt et al.
2005/0058312 A1 3/2005 Weidner

FOREIGN PATENT DOCUMENTS

WO WO-00/76268 A2 12/2000
WO WO-02/28143 A2 4/2002
WO WO-2004/114722 A1 12/2004

* cited by examiner

*Primary Examiner* — Suhan Ni
(74) *Attorney, Agent, or Firm* — Birch, Stewart, Kolasch & Birch, LLP

(57) ABSTRACT

This invention relates to a hearing aid system (100, 200, 300) for generating auditory spatial cues. The hearing aid system (100, 200, 300) comprises a first microphone unit (306) adapted to convert sound received at a first microphone (102) and received at a second microphone (104), a first delay unit (106) connected to the first microphone (102) delaying the signal from the first microphone (102), a first calculation unit (108) for summing the delayed signal of the first microphone (102) and signal of the second microphone (104), a processor unit (110) processing the summed signal, and a speaker converting the processed signal to a processed sound. The first and second microphones (102, 104) are separated by a predetermined first distance and the first delay unit (106) provides a predetermined first delay thereby generating a first auditory spatial cue representing a first spatial dimension in the summed signal.

18 Claims, 3 Drawing Sheets

SYSTEM AND METHOD FOR GENERATING AUDITORY SPATIAL CUES

This Nonprovisional application claims priority under 35 U.S.C. §119(e) on U.S. Provisional Application Nos. 60/786,377 filed on Mar. 28, 2006, the entire contents of which are hereby incorporated by reference.

FIELD OF INVENTION

This invention relates a system and method for generating auditory spatial cues. In particular, this invention relates to a hearing aid such as a behind-the-ear (BTE), in-the-ear (ITE), completely-in-canal (CIC), receiver-in-the-ear (RITE), middle-ear-implant (MEI) or cochlear implant (CI), wherein the hearing aid compensates for a hearing-impaired user's lost sense of the spatial locations of sounds.

BACKGROUND OF INVENTION

A normal-hearing person has an inherent sense of the location of sounds in his spatial surroundings. This inherent sense is achieved by the fact that sound emitted somewhere in the spatial surroundings of the person is transmitted both directly and indirectly to the ear canal. Hence sound reflections from the body of the person i.e. torso, shoulders, head, neck and external part of ears, provide a head-related transfer function (HRTF). In the frequency domain the HRTF consists of a plurality of dips and peaks, which are caused by the constructive and destructive summing of reflected and thus time delayed sounds and direct sound before arrival in the ear canal. These dips and/or peaks are generally referred to as auditory spatial cues.

The pattern of auditory spatial cues in a HRTF is dependent on the spatial location of the source emitting the sound, relative to the ear and body structures causing the reflections. Hence the auditory spatial cues may assist the normal-hearing person to locate where sounds originate from in the spatial surroundings.

The normal-hearing person has an inherent means for selecting, concentrating, or parsing his hearing for particular sounds in the spatial surroundings by using the auditory spatial cues. However, if the auditory spatial cues occur in a frequency range where the person has a hearing impairment this affects the person's ability to determine the location of sound sources. Not only may the auditory spatial cues be inaudible due to having insufficient intensity to overcome the listener's hearing threshold, but the reduced perceptual frequency resolution which often accompanies hearing impairment may also cause the cues to lose distinctness and thus utility.

International patent application no.: WO 03/009639 discloses a directional acoustic receiver such as a microphone array or a human external ear that has a varying acoustic impulse response with the direction in space of the sound source relative to the acoustic receiver. The international patent further discloses a method for recording and reproducing a three dimensional auditory scene for listeners by recording a three dimensional auditory scene using the microphone array, modifying the sound recorded by the microphone array using information derived from differences between directional acoustic transfer function of the microphones in the microphone array and the directional acoustic transfer functions of the external ears of the listener, and collecting, arranging and combining the signals intended for the left and right external ear of the listener into an output format identifying these signals as a representation of a three dimensional auditory scene that enables a perceptually valid acoustic reproduction of the sound that would have been present at the ears of the listener, were the listener to have been present at the position of the microphone array in the original sound environment. Hence the international patent application relates to a system for recreation of a sound for a listener in a spatial position as if the listener was in the position of the microphone array in the originally recorded sound. However, the international patent application fails to disclose an acoustic receiver compensating for the perceptual degradation of spatial hearing suffered by a listener with a hearing impairment.

International patent application no.: WO 2005/015952 discloses a hearing device for enhancing sound heard by a hearing-impaired listener by monitoring sound in an environment in which the listener is located, and manipulating the frequency placement of high-frequency components of the sound in a high-frequency band (e.g. above 4 kHz) so as to make the spectral features corresponding to auditory spatial cues audible to the hearing-impaired listener, thus aiding in the listener's sound externalisation and spatialisation. The hearing aid comprises a processor for transposing the spectral features from a high-frequency band to a lower-frequency band. The processor transposes the high-frequency spectral features by performing a Fast Fourier Transform (FFT) and modifying the frequency representation of the signal, or by performing a re-sampling technique on the received signal in the time domain and shifting and/or compressing the high-frequency spectral features to a lower frequency band. However, the hearing device according to the international patent application utilises a complicated algorithmic manipulation of the signal, which introduces domain shifts generally requiring great processing time and importantly takes up physical space on a signal processing chip, which for a hearing device already faces tremendous restrictions as to availability of space.

International patent application WO 99/14986 discloses a system for transposing high-frequency band auditory cues to a lower frequency band by proportionally compressing the audio signal. The system achieves this objective by maintaining the spectral shape of the audio signal, while scaling its spectrum in the frequency domain, via frequency compression, and transposing its spectrum in the frequency domain, via frequency shifting. Hence the system comprises a Fast Fourier Transform (FFT) unit for transforming the audio signal from time domain to frequency domain, a processor for performing scaling and transposing functions on the frequency signal, and finally an inverse FFT unit for transforming the scaled and transposed frequency signal back into the time domain. However, as mentioned above with reference to international patent application no.: WO 2005/015952 the system according to the international patent application no: WO 99/14986 also utilises a similar complicated algorithmic manipulation of the signal, which obviously requires processing time and space.

In addition, American patent application no.: US 2006/0018497, discloses a hearing aid worn on the head for binaural provision of a user. The hearing aids are coupled to each other in such a way that a precisely matched acoustic signal can be emitted in the left and right ear. By feeding acoustic signals to the left and right hearing aids and phase shifting one acoustic signal relative to the other the user gets the impression that the acoustic signal originates from an acoustic signal source with a certain position in the space. This perception of sound originating from various spatial positions is utilised in the hearing aids for informing the user about settings or system states of the hearing aids.

Finally, the article entitled "Lokalisationsversuche für virtuelle Realität mit einer 6-Mikrofonanordnung" by Podlaszewski et al, published in Akustik-DAGA 2001, Hamburg-Harburg, page 278 and 279, discloses a method for establishing a virtual acoustic room utilising a 6-microphone unit. The method includes measuring of a HRTF of a person and modifying filter parameters of each of the microphones of the microphone unit until the transfer function of the microphone unit substantially matches the HRTF of the person. The article thus discloses a method for potentially improving a person's sound experience of a virtual room.

None of the above prior art documents provide a simple and inexpensive solution for introducing auditory spatial cues in a low-frequency range. The disclosed prior art systems introduce further computations requiring extensive processor capabilities, and place constraints on the positioning of microphones which limit their application.

SUMMARY OF THE INVENTION

An object of the present invention is to provide an improved hearing aid generating new auditory spatial cues.

It is a further object of the present invention to provide a hearing aid improving a user's own sense of auditory space.

A particular advantage of the present invention is the provision of a hearing aid wherein the introduction of new auditory spatial cues require very little processing time and thus require very little physical space on a signal processing chip.

The above objects and advantage together with numerous other objects, advantages and features, which will become evident from below detailed description, are obtained according to a first aspect of the present invention by a hearing aid system for generating auditory spatial cues and comprising a first microphone unit adapted to convert sound received at a first microphone to a first electric signal on a first output and received at a second microphone to a second electric signal on a second output, a first delay unit connected to said first output and adapted to delay said first electric signal, a first calculation unit connected to said first delay unit and said second output and adapted to sum said delayed first electric signal and said second electric signal and to generate a first summed signal, a processor unit connected to said first calculation unit and adapted to process said first summed signal and to generate a processed signal, and a speaker adapted to convert said processed signal to a processed sound, wherein said first and second microphones are separated by a predetermined first distance and said first delay unit provides a predetermined first delay thereby generating a first auditory spatial cue representing a first spatial dimension in said first summed signal.

The term "auditory spatial cue" is in this context to be construed as a dip, notch or peak in the frequency response of a signal presented to a user.

The term "spatial dimension" is in this context to be construed as a part of a spherical orientation as, for example may be represented by the r, θ, and ϕ spherical coordinate system. The spatial dimension thus may comprise a semicircular part of the polar angle ϕ, whereas the polar axis is construed as the axis through the first and second microphones.

The term "first" is in this context to be construed as entirely a means for distinguishing or differentiating between a plurality of elements, i.e. a first, second, and third element is not to be construed as a sequential series starting with the first element.

In addition, the term "speaker" is in this context to be construed as a receiver or miniature loudspeaker.

By utilising a set of microphones wherein the individual microphones are separated by the predetermined distance, the sound originating from a sound source at one spatial location may, when converted at each of the microphones, differ since the distance from each of the microphones to the sound source may be different causing the sound reaching the first microphone to be time-delayed or time-advanced relative to the sound reaching the second microphone. Therefore summing of the first and second electric signal, advantageously, generates a first auditory spatial cue in the frequency spectrum of the summed signal. By moving the sound source in the first spatial dimension the first auditory spatial cue is shifted in the frequency domain thus enabling the user to experience a sense of sound location in the first spatial dimension.

Further, by appropriately selecting the distance between the microphones and the time delay, the frequency of the first auditory spatial cue may, advantageously, be placed in an optimum frequency range for the user of the hearing aid system. Consequently, the hearing aid system according to the first aspect of the present invention provides a new auditory cue for a first spatial dimension, which may be used by the user of the hearing aid system to improve the user's sense of sound location thereby enabling the user to select, concentrate, or parse hearing for particular sounds in the spatial surroundings.

The microphone unit according to the first aspect of the present invention may further comprise a third microphone for converting sound to a third electric signal on a third output, and wherein the third microphone is separated perpendicularly relative to an axis between the first and second microphones by a second predetermined distance. By introducing the third microphone a second spatial dimension may be accomplished.

The hearing aid system according to the first aspect of the present invention may further comprise a filter unit connecting to the third output and adapted to filter the third electric signal thereby generating a filtered third electric signal. The filter unit removes unnecessary auditory spatial cues so that the user is presented with a single auditory spatial cue for a second spatial dimension. Hence the hearing aid system according to the first aspect of the present invention generates a first auditory spatial cue based on the sound received at the first and second microphones and a second auditory spatial cue based on the sound received at the third microphone relative to the summed signal from the first and second microphones.

The hearing aid system according to the first aspect of the present invention may further comprise a second delay unit connecting to the first calculation unit and adapted to delay the first summed signal. Alternatively, the hearing aid system may comprise a second delay unit connecting to the filter unit and adapted to delay the filtered third electric signal. Alternatively, the hearing aid system may comprise a second delay unit connecting to the third microphone and adapted to delay the third electric signal. Further alternatively, the hearing aid system may comprise a plurality of second delay unit connecting to the third microphone, the filter unit, and/or first calculation unit, and adapted to delay the third electric signal, the filtered third electric signal and/or the first summed signal. By introducing a second delay to the first summed signal and introducing the second predetermined distance the positioning of the second auditory spatial cue may be placed in an optimum frequency range for the hearing aid user.

The hearing aid system according to the first aspect of the present invention may further comprise a second calculation unit connecting to the second delay unit and the filter unit and adapted to sum the delayed filtered first summed signal and the filtered third electric signal. Hence the first and second auditory cues are thereby introduced into the signal presented to the user of the hearing aid system.

The first calculation unit according to the first aspect of the present invention may further be adapted to weight the delayed first electric signal and the second electric signal. Similarly, the second calculation unit may further be adapted to weight the delayed filtered first summed signal and the filtered third electric signal. This advantageously enables a more general solution since the signals may be multiplied by weighting factors before summing. In practice weigthing enables adjusting the depth/height of the spectral dips/peaks.

The hearing aid system according to the first aspect of the present invention may further comprise a transceiver unit connecting to the first microphone unit and adapted to transmit the first, second and/or third electric signal of a first hearing aid to a transceiver unit of a second hearing aid, which may comprise a second microphone unit separated from the first microphone unit by a third predetermined distance being perpendicular to the axis between the first and second microphone. The transceiver unit may further be adapted to receive electric signals from said second microphone unit. By utilising communication between a first and second hearing aid of the hearing aid system an auditory cue for a third spatial dimension may be achieved thus providing a further improved sense of sound location for a user.

The transceiver unit according to the first aspect of the present invention may comprise a third delay unit adapted to delay the first, second, and/or third electric signal by a third predetermined delay. The third predetermined delay unit may as well as the third predetermined separation advantageously be used for positioning of a third auditory spatial cue in an optimal frequency range for the user.

The hearing aid system according to the first aspect of the present invention may further comprise a calculation device adapted to be carried elsewhere on the user's body and communicating with the transceivers of the first and second hearing aids and adapted to generate a first, second and/or third auditory spatial cues associated with spatial orientation of sound received at the first and second microphone unit. The calculation device may comprise a third microphone unit adapted to provide a further electric signal for generating a further auditory spatial cue.

Hence the hearing aid system according to the first aspect of the present invention advantageously does not require a microphone to be exposed to the pinna's natural reflection patterns, does not require any algorithmic manipulation of the digitised signal, and it creates no non-linear distortions of the true acoustic signal.

The hearing aid system according to the first aspect of the present invention may further comprise a first filterbank connecting to the first microphone and adapted to generate a first series of frequency channel signals from the first electric signal and second filterbank connected to the second microphone and adapted to generate a second series of frequency channel signals from the second electric signal, and wherein the first delay unit is adapted to independently delay each of said first series of frequency channel signals and the first calculation unit is adapted to independently sum each of said delayed first series of frequency channel signals and said second series of frequency channel signals. The filterbank enables that each microphone signal may be filtered into a plurality frequency channels and that each channel may be processed by its own set of further filter, calculation and delay units before being recombined in a processing unit to be presented to the user. Thus a multiplicity of auditory spatial cues may be optimally placed in a multiplicity of frequency ranges.

The hearing aid system according to the first aspect of the present invention may further comprise A/D, D/A conversion units adapted to convert the microphone signals from analogue to digital domain and to convert the processed signal from digital to analogue domain. This obviously provides improved capability in performing detailed calculations on the signals. The above objects, advantages and features together with numerous other objects, advantages and features, which will become evident from below detailed description, are obtained according to a second aspect of the present invention by a method for generating auditory spatial cues and comprising generating a first electric signal defining a sound received at a first position, generating a second electric signal defining said sound received at a second position, delaying said first electric signal a predetermined first time delay thereby generating a delayed first electric signal, summing said delayed first electric signal and said second electric signal thereby generating a first summed signal having a first auditory cue representing a first spatial dimension, processing said first summed signal, and converting said processed signal to a processed sound.

The method according to the second aspect of the present invention may comprise any features of the hearing aid system according to the first aspect of the present invention.

The method according to the second aspect of the present invention is particularly advantageous since it enables the adaptation of the auditory cues to a user of a hearing aid system to be performed by simulating sounds originating from various positions in a three-dimensional space without actually having to move a loudspeaker around in said space. The simulation may be performed by phase-shifting the first electric signal relative to the second electric signal.

BRIEF DESCRIPTION OF THE DRAWINGS

The above, as well as additional objects, features and advantages of the present invention, will be better understood through the following illustrative and non-limiting detailed description of preferred embodiments of the present invention, with reference to the appended drawing, wherein.

DETAILED DESCRIPTION OF PREFERRED EMBODIMENTS

In the following description of the various embodiments, reference is made to the accompanying figures, which show by way of illustration how the invention may be practiced. It is to be understood that other embodiments may be utilized and structural and functional modifications may be made without departing from the scope of the present invention.

Figure 1:
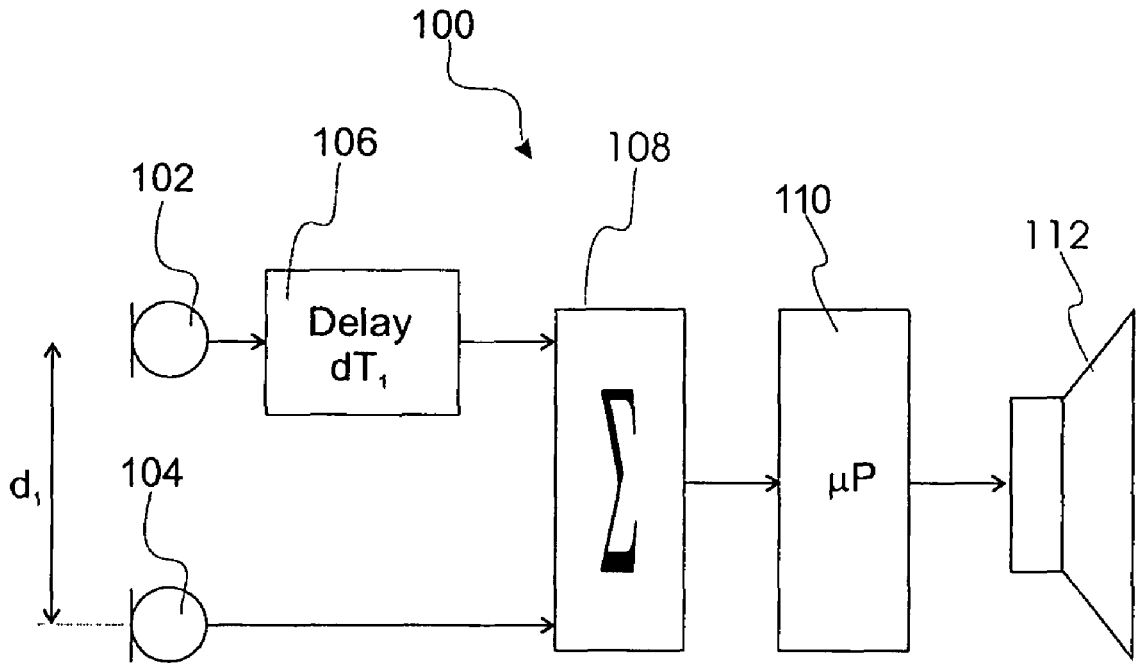
FIG. 1, shows a hearing aid system according to a first embodiment of the present invention.

FIG. 1 shows a hearing aid system according to a first embodiment of the present invention and designated in entirety by reference numeral 100. The hearing aid system 100 comprises a first and second microphone 102 and 104 for converting the sound into a first and second electric signal, respectively. The first and second microphones 102 and 104 are separated by a distance $d_1$ between the centers of the membranes of the first and second microphones 102 and 104.

The first electric signal is time delayed by a delay unit 106 before being communicated to a first calculation unit 108, which weights and sums the delayed first electric signal and the second electric signal. By positioning of the first and second microphones 102, 104 relative to one another by the distance $d_1$ and by adjusting the time delay of the first electric signal the output of the first calculation unit 108 provides a first auditory spatial cue, which in case of movement of the sound source shifts up and down in the frequency spectrum of the summed signal. In case the first and second microphones 102 and 104 are positioned vertically relative to one another and relative to a user standing upright, the change in frequency of the auditory spatial cue represents a change in elevation of the sound source.

The summed signal is communicated from the first calculation unit 108 to a signal processing unit 110, which performs any signal processing required in accordance with the user's hearing impairment. That is, the processor performs the general frequency shaping, compression and amplification required to obtain an audible signal to the user through a speaker 112.

During adaptation of the hearing aid system 100 to the user, it may be advantageous decouple the first and second microphones 102 and 104 and generate the first and second electric signal by means of a signal generator so as to simulate a sound environment. Hence the effect of changing the position of the sound source may be achieved without having to move a source loudspeaker round during the adaptation. The simulated sound established by the signal generator may be established by phase-shifting the first electric signal relative to the second electric signal.

Figure 2:
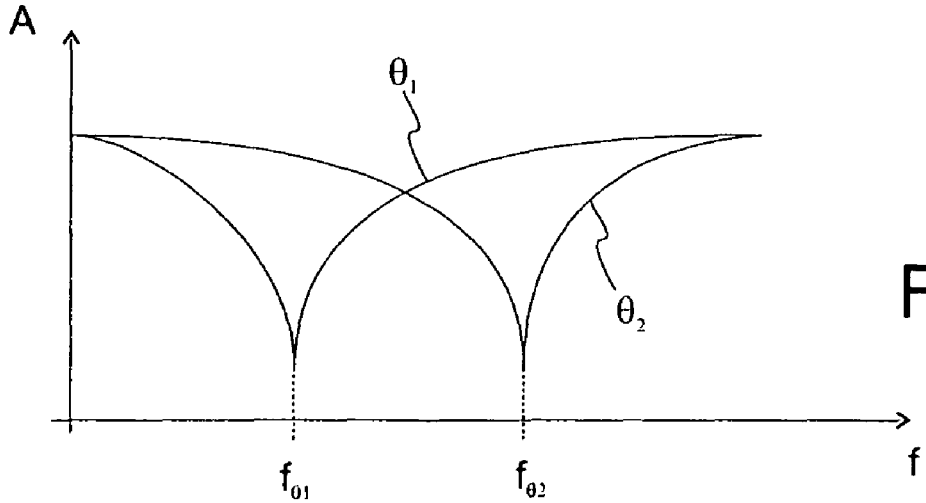
FIG. 2, shows a graph of the change of frequency spectrum of a sound as angle θ changes.

FIG. 2 shows a graph of the summed signal as a function of frequency at a first and second elevation angle $\theta_1$ and $\theta_2$ when the first and second microphones 102 and 104 are positioned vertically relative to one another and relative to a user standing upright. The auditory spatial cue (notch) changes as the elevation angle $\theta$ changes thus helping the hearing-impaired user, who otherwise has limited sense of sound directionality due to the fact that the normal auditory cues caused by HRTF are in a frequency range where the user has a hearing impairment.

Figure 3:
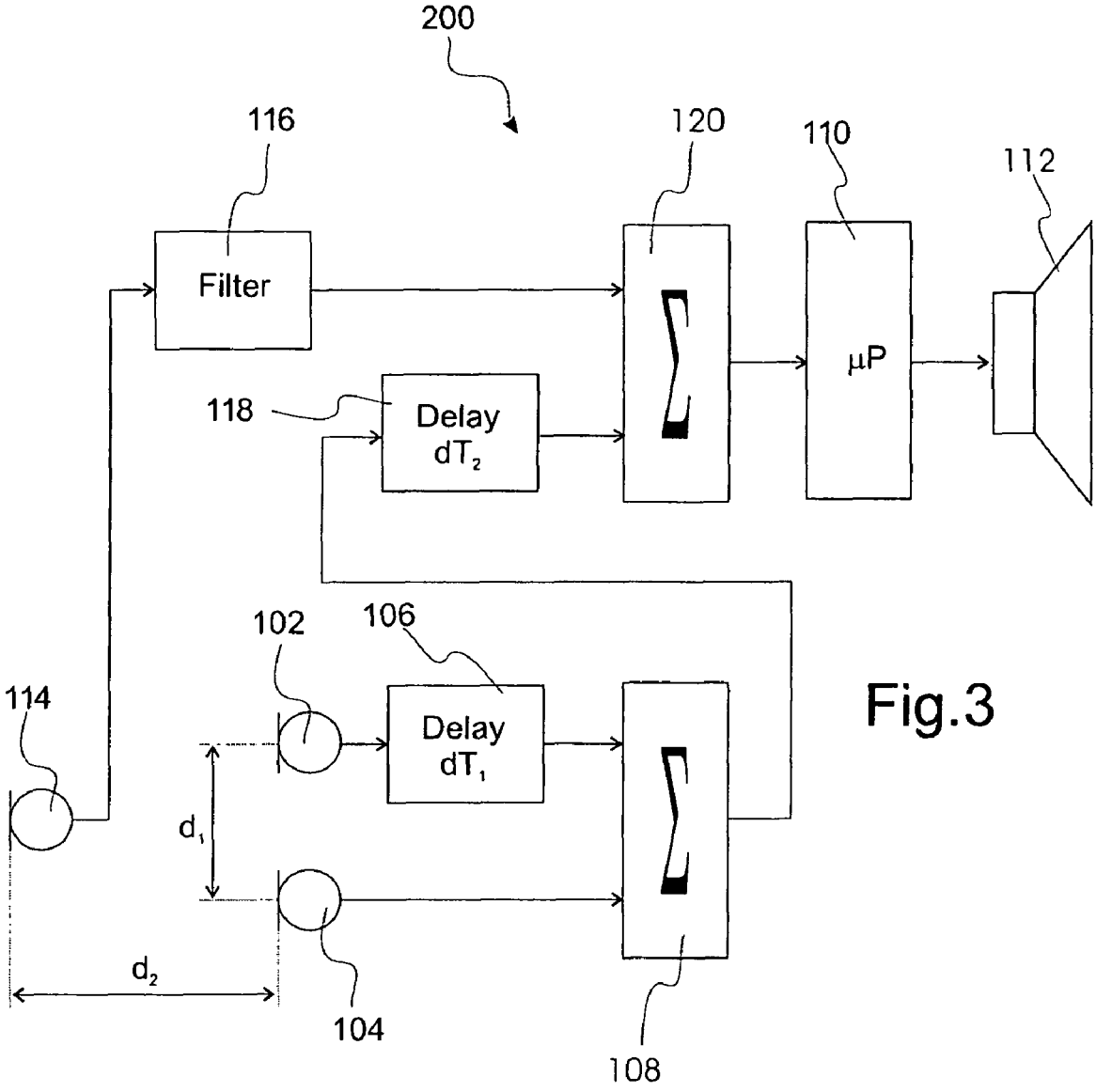
FIG. 3, shows a hearing aid system according to a second embodiment of the present invention.

FIG. 3 shows a hearing aid system according to a second embodiment of the present invention and designated in entirety by reference numeral 200. The hearing aid system 200 comprises some of the elements of the hearing aid system 100, which elements are referenced using the same reference numerals.

The hearing aid system 200 comprises a third microphone 114 separated perpendicularly relative to the axis of the first and second microphones 102, 104 by a distance $d_2$. The third microphone 114 converts the sound to a third electric signal, which is forwarded to a filter 116 with for example a low-pass cut-off frequency lying for example between 2 kHz and 4 kHz thereby avoiding the occurrence of auditory cues above the cut-off frequency to ensure that the first elevation auditory cue provided by microphones 102 and 104 is not disturbed.

In one particular embodiment the first and second microphones 102 and 102 may be placed on a behind-the-ear component of a hearing aid, while the third microphone 114 may be placed on a receiver-in-the-ear, ear-mould or ear-plug part of the hearing aid having its membrane facing outward.

The filtered third electric signal is communicated to a second calculation unit 120, which connects to the filter unit 116 and to a second delay unit 118 delaying the first summed signal and which weights and sums the filtered third electric signal and the first summed signal. The second calculation unit 120 generates a second summed signal within which is encoded for example an elevation auditory cue and a front/back auditory cue based on the filtered third electric signal and the first summed signal. Subsequently, the second summed signal is forwarded to the processing unit 110 and the speaker 112.

Figure 4:
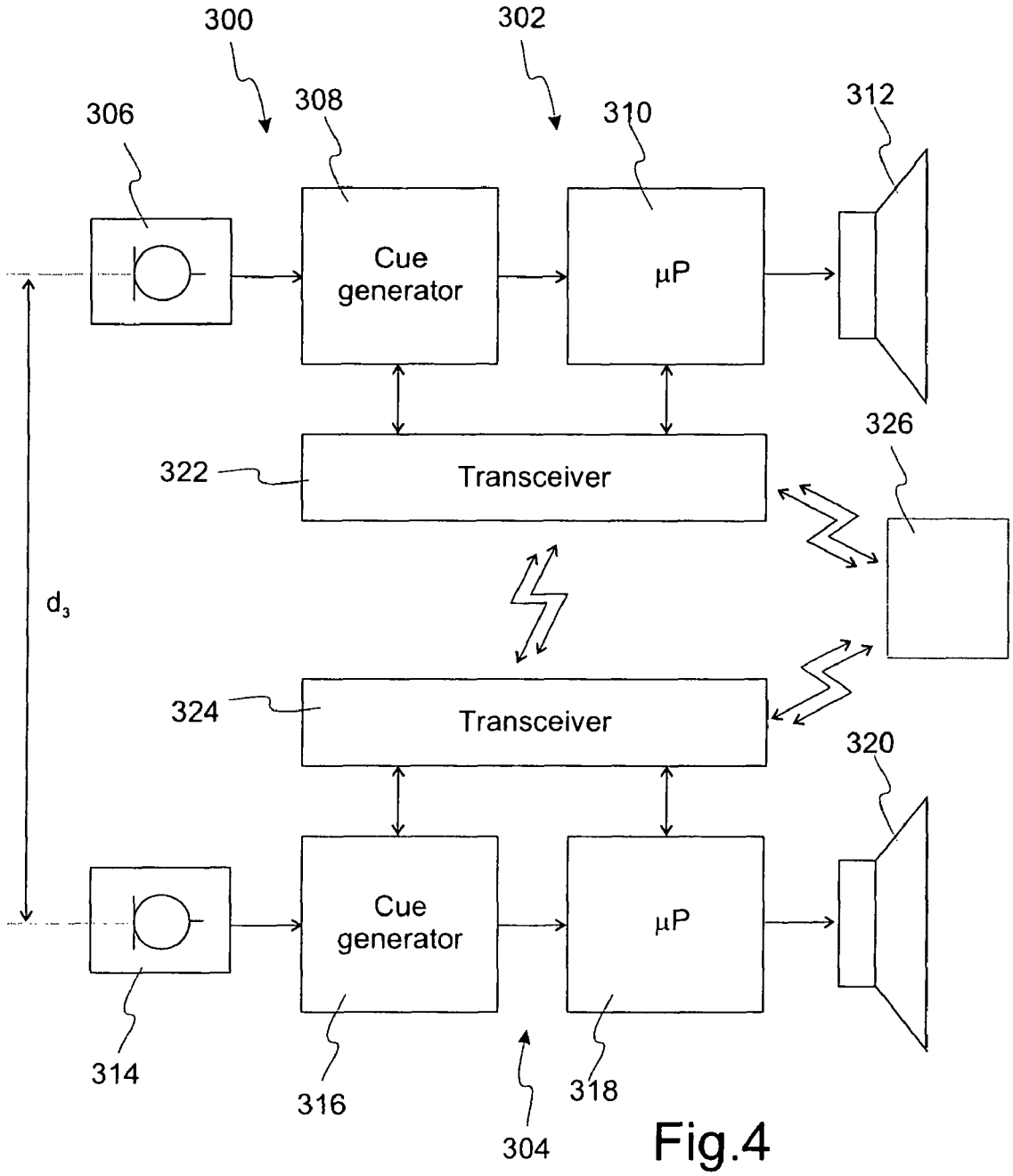
FIG. 4, shows a hearing aid system according to a third embodiment of the present invention.

FIG. 4 shows a hearing aid system according to a third embodiment of the present invention and designated in entirety by reference numeral 300. It should be understood that the hearing aid system 300 may incorporate features of the hearing aid systems designated 100 and 200.

The hearing aid system 300 comprises a first and second hearing aid 302 and 304. The first hearing aid 302 comprises elements of hearing aid systems 100 and 200, that is, comprises a first microphone unit 306 generating a first, second and/or third electric signal from a sound. These signals are communicated to a first auditory cue generator 308 generating an elevation auditory cue and/or a front/back auditory cue in a first summed signal communicated to a first processing unit 310 performing the, normally, required processing operations in accordance with sound and hearing impairment of the user before communicating a processed signal to a speaker 312.

The second hearing aid 304 similarly comprises elements of hearing aid systems 100 and 200, that is, comprises a second microphone unit 314 generating a first, second and/or third electric signal from a sound. These signals are communicated to a first auditory cue generator 316 generating an elevation auditory cue and/or a front/back auditory cue in a second summed signal communicated to a second processing unit 318 performing the required audio-logical operations in accordance with sound and hearing impairment of the user before communicating a processed signal to a speaker 320.

The first hearing aid further comprises a first transceiver unit 322 for transmitting and receiving first, second, and/or third electric signals from the first and second microphone units 306 and 314. The first transceiver 322 includes a time delay unit for time delaying the first, second and/or third electric signal prior to summing, and the time delaying of the first, second and/or third electric signal together with the distance $d_3$ between the microphone units 306 and 314 determine the position of a rotation auditory cue in addition to the elevation auditory cue and the front/back auditory cue.

The second hearing aid similarly further comprises a second transceiver unit 324 for transmitting and receiving first, second, and/or third electric signals from the first and second microphone units 306 and 314. The second transceiver 322 also includes a time delay unit for time delaying the first, second and/or third electric signal prior to summing, and the time delaying of the first, second and/or third electric signal together with the distance $d_3$ between the microphone units 306 and 314 determine the position of a rotation auditory cue in addition to the elevation auditory cue and the front/back auditory cue.

The first and second transceiver units 322 and 324 may be communicating through a connecting wire or by wireless transmission.

In addition, the hearing aid system 300 according to the third embodiment of the present invention may comprise a body worn calculation device 326 communicating with the first and second transceiver units 322 and 324.

The body worn calculation device 326 may be carried elsewhere on the user's body and comprises a time delay unit for appropriately delay the first, second and/or third electric signals from the first and second microphone unit 306 and 314 and being encoded with the predetermined distances $d_1$, $d_2$ and $d_3$. The body worn calculation device 326 may perform the required delay and summing functions and return appropriate auditory cues to the first and second transceiver 322 and 324. Further, the body worn calculation device 326 may comprise a third microphone unit to be used for further specifying the auditory cues in all spatial dimensions.

As described above referring to FIG. 1 the adaptation of the hearing aid system 300 to the user may advantageously be accomplished by decoupling the first and second microphone units 306 and 314 and generating the first, second, and third electric signal by means of a signal generator so as to simulate a sound environment. The first and transceiver units 322 and 324 may receive the first, second, and electric signal simulating a specific sound from the signal generator transmitting directly to each of the hearing aids 302 and 304.

The invention claimed is:

1. A hearing aid system for generating auditory spatial cues, comprising:

a first microphone unit configured to convert sound received at a first microphone to a first electric signal on a first output and received at a second microphone to a second electric signal on a second output;

a first delay unit connected to said first output and configured to delay said first electric signal;

a first calculation unit connected to said first delay unit and said second output and configured to sum said delayed first electric signal and said second electric signal and to generate a first summed signal;

a processor unit connected to said first calculation unit and configured to process said first summed signal and to generate a processed signal; and a speaker configured to convert said processed signal to a processed sound, wherein said first microphone and said second microphone are separated by a predetermined first distance, and said first delay unit is adjusted to provide a predetermined first time delay of said first electric signal causing said first calculation unit to generate a first auditory spatial cue representing a first spatial dimension in said first summed signal to a user.

2. A hearing aid system according to claim 1, wherein the first microphone unit further comprises a third microphone for converting sound to a third electric signal on a third output, and wherein the third microphone is separated perpendicularly relative to an axis between the first and second microphones by a second predetermined distance.

3. A hearing aid system according to claim 2 further comprising a second delay unit connecting to the third microphone and adapted to delay the third electric signal.

4. A hearing aid system according to claim 2 further comprising a filter unit connecting to the third output and adapted to filter the third electric signal thereby generating a filtered third electric signal.

5. A hearing aid system according to claim 4 further comprising a second delay unit connecting to the filter unit and adapted to delay the filtered third electric signal.

6. A hearing aid system according to claim 5, further comprising:

a second calculation unit connecting to the second delay unit, the filter unit, and the processor unit, wherein the second calculation unit is configured to generate a second auditory spatial cue representing a second spatial dimension in a second summed signal to a user, based on said second predetermined distance and time delay of said second delay unit.

7. A hearing aid system according to claim 6, wherein, the second calculation unit further is adapted to weight the delayed filtered first summed signal and the filtered third electric signal.

8. A hearing aid system according to claim 4 further comprising a plurality of second delay unit connecting to the third microphone, the filter unit, and/or first calculation unit, and adapted to delay the third electric signal, the filtered third electric signal and/or the first summed signal.

9. A hearing aid system according to claim 2 further comprising a transceiver unit connecting to the first microphone unit and adapted to transmit the first, second and/or third electric signal of a first hearing aid to a transceiver unit of a second hearing aid, which comprises a second microphone unit separated from the first microphone unit by a third predetermined distance being perpendicular to the axis between the first and second microphone.

10. A hearing aid system according to claim 9, wherein the transceiver unit further is adapted to receive electric signals from said second microphone unit.

11. A hearing aid system according to claim 9, wherein the transceiver unit comprises a time delay unit adapted to delay the first, second, and/or third electric signal a predetermined time delay.

12. A hearing aid system according to claim 1 further comprising a second delay unit connecting to the first calculation unit and adapted to delay the first summed signal.

13. A hearing aid system according to claim 1, wherein the first calculation unit further is adapted to weight the delayed first electric signal and the second electric signal.

14. A hearing aid system according to claim 9, further comprising:

a body worn calculation device communicating with the transceivers of the first and second hearing aids and adapted to generate a first, second and/or third auditory spatial cues associated with spatial orientation of sound received at the first and second microphone unit.

15. A hearing aid system according to claim 14, wherein the body worn calculation device comprises a third microphone unit adapted to provide a further electric signal for generating a further auditory spatial cue.

16. A hearing aid system according to claim 1 further comprising a first filterbank connecting to the first microphone and adapted to generate a first series of frequency channel signals from the first electric signal and second filterbank connected to the second microphone and adapted to generate a second series of frequency channel signals from the second electric signal, and wherein the first delay unit is adapted to independently delay each of said first series of frequency channel signals and the first calculation unit is adapted to independently sum each of said delayed first series of frequency channel signals and said second series of frequency channel signals.

17. A hearing aid system according to claim 1 further comprising A/D, D/A conversion units adapted to convert the microphone signals from analogue to digital domain and to convert the processed signal from digital to analogue domain.

18. A method for generating auditory spatial cues, comprising:

generating a first electric signal defining a sound received at a first position;

generating a second electric signal defining said sound received at a second position;

delaying said first electric signal a predetermined first time delay thereby generating a delayed first electric signal;

summing said delayed first electric signal and said second electric signal thereby generating a first summed signal having a first auditory spatial cue representing a first spatial dimension;

processing said first summed signal; and converting said processed signal to a processed sound.

* * * * *